United States Patent [19]

Casey et al.

[11] 4,350,135

[45] Sep. 21, 1982

[54] SUPERCHARGING SYSTEM FOR AN INTERNAL COMBUSTION ENGINE

[75] Inventors: Gary L. Casey, Troy; Bruce J. Harvey, Sterling Heights; Kenneth A. Hebert, Garden City; William C. Eddy, West Bloomfield, all of Mich.

[73] Assignee: The Bendix Corporation, Southfield, Mich.

[21] Appl. No.: 88,970

[22] Filed: Oct. 29, 1979

[51] Int. Cl.[3] ..... F02B 33/36

[52] U.S. Cl. ..... 123/564; 418/138

[58] Field of Search ..... 60/611; 123/559, 564, 123/565

[56] References Cited

U.S. PATENT DOCUMENTS

| | | | |
|---|---|---|---|
| 1,630,634 | 5/1927 | Porsche | 123/559 |
| 1,645,178 | 10/1927 | Hall-Brown | 123/559 |
| 1,651,250 | 11/1927 | Brownback | 123/559 |
| 2,067,757 | 1/1937 | Fielden | 123/564 |
| 2,233,307 | 2/1941 | Dodson | 123/564 |
| 2,283,644 | 5/1942 | Nallinger | 123/564 |
| 2,346,916 | 4/1944 | Halford et al. | 123/564 X |
| 2,486,047 | 10/1949 | Marinelli | 123/561 X |
| 3,568,435 | 3/1971 | May | 60/611 X |
| 3,941,035 | 3/1976 | Mueller | 60/602 X |

FOREIGN PATENT DOCUMENTS

| | | | |
|---|---|---|---|
| 855640 | 11/1952 | Fed. Rep. of Germany | 123/559 |
| 860572 | 12/1952 | Fed. Rep. of Germany | 60/611 |
| 635823 | 1/1928 | France | 123/564 |
| 1263461 | 5/1961 | France | 123/559 |

*Primary Examiner*—Michael Koczo, Jr.

*Attorney, Agent, or Firm*—G. P. Haas, Jr.; J. R. Ignatowski; R. C. Wells

[57] ABSTRACT

A supercharging system for an internal combustion engine, consisting of a positive displacement air pump mechanically driven by the engine, and an electromagnetic clutch activated during high torque demand operating conditions. The system produces a high torque output in a high torque demand range from a relatively small displacement engine, with economy operation during normal engine operating conditions. A flow modulation control system provides a smooth transition from natural aspiration to supercharged operating conditions and includes a sensing of the pressure drop across the throttle plate and modulation of the supercharger air flow into the engine intake in accordance with the sensed pressure differential. The flow modulation also enables high efficiency supercharging with the engine operating under partial pressure supercharging as required in ascending a grade. The air pump design is a specially configured vane pump in which the vanes are dynamically biased in an axial direction by forces generated during rotation of the air pump vanes enabling the use of a relatively simplified low cost bearing arrangement for the vanes.

18 Claims, 11 Drawing Figures

Fig-5
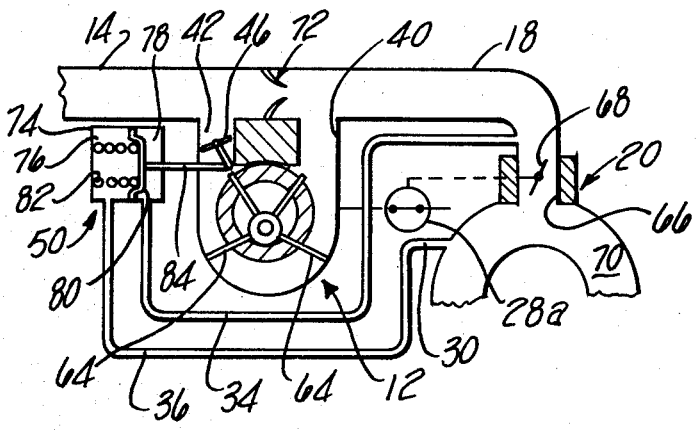
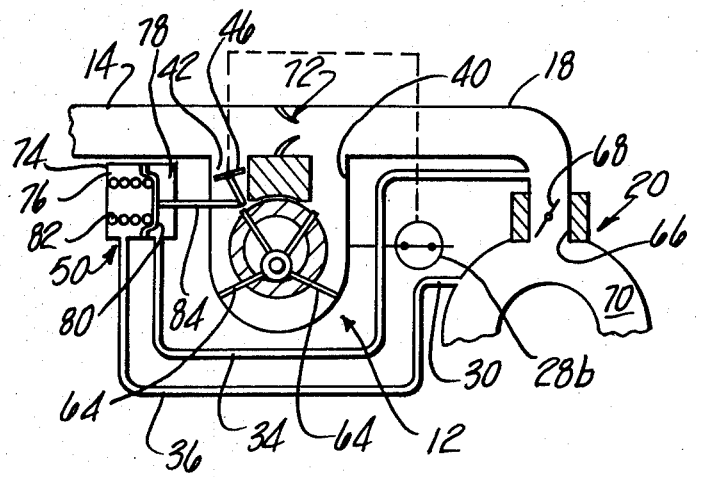
Fig-6

SUPERCHARGING SYSTEM FOR AN INTERNAL COMBUSTION ENGINE

BACKGROUND DISCUSSION

The current emphasis on fuel economy in the design of power plants for automotive application has resulted in efforts to improve the performance of relatively small displacement engines so as to provide adequate performance characteristics under high torque demand conditions while enjoying the relatively moderate fuel usage associated with such small displacement engines.

Supercharges have long been utilized to boost the power output of internal combustion piston engines of both spark and compression ignition. One common supercharger arrangement currently in use is the turbocharger, in which the engine exhaust flow is utilized to drive an exhaust turbine, which in turn drives a compressor turbine to provide supercharged air flow from the turbine compressor to the engine intake manifold. Such turbochargers of necessity must run at relatively high rotative speeds, i.e., on the order of 80,000 to 100,000 rpm, which requires relatively costly construction.

Furthermore, the nature of the exhaust gas flow and the turbine drive arrangements is such that the supercharging flow increases exponentially and creates relatively inadequate boost pressures at low engine speeds and excessive boost pressures at relatively high engine speed in the absence of control arrangements for reducing flow.

Thus, the torque available at low speeds is not adequate for optimal performance characteristics and in addition requires an arrangement for bypassing of the exhaust flow from the turbine at relatively high engine speeds or some other means to eliminate the excess boosting of pressure which would otherwise occur.

On the other hand, such units do afford the advantages of relatively smooth transitions from natural aspiration to supercharged operation and utilizing a driving force hot exhaust gas, the energy of which would otherwise be largely wasted. In addition, these devices are sensitive to back pressure in the development of output flow and can operate under relatively high back pressure without corresponding decreases in efficiency.

Mechanical engine driven blower arrangements have also been utilized in the past, some of which were nonpositive displacement turbine-type compressors which, as in the above designs, do not provide adequate flow at low engine speeds in order to satisfy the aforementioned desired performance criteria.

Positive displacement type air pumps have been employed which in many cases were driven by the engine at all times to provide supercharging under all engine operating conditions. This compromises the potential economy of operation of low displacement engines, inasmuch as the economy of operation of such engines which are constantly supercharged is not improved over larger displacement engines exhibiting similar performance characteristics.

There has thus been provided arrangements in enabling the operating of the mechanically driven blowers to be activated only in a predetermined engine operating range by means of on/off clutches and the like.

Difficulties are involved in the use of an on/off mechanically driven positive displacement pump, particularly of a high volume output which is required to enable high torque to be generated at relatively low engine speed.

One difficulty is in the transition period when the clutch is first engaged to initiate blower operation. The engine goes from a situation of natural aspiration to a situation in which there is a large stepped increase in the intake air pressure which causes an objectionable torque surge particularly for larger displacement engines.

Such torque surge is not present in the turbocharger design since the nonpositive flow characteristics of turbines enables a relatively smoother transition and also these devices are often operated throughout the range of engine operating conditions.

That is, if the air pump is not provided with a variable speed drive upon activation of the air pump, a relatively large sudden increase in the intake pressure to the engine results, i.e., for example, a six psi increase over atmospheric pressure. For a spark ignition engine, such pressure corresponds substantially directly to the torque output of the engine, i.e., the increase intake pressure produced is an increased air flow through the carburetor, in turn inducing a corresponding increase in the mass of fuel-air mixture into the engine cylinders and a corresponding increase in torque output of the engine.

It can be seen that if the air pump is activated with a stepped increase in air flow to the engine, the corresponding increase in torque produces the sudden increase in torque noted above.

A further difficulty in the operation of positive displacement pumps is encountered during engine operation at supercharger boost pressures below peak boost pressure. Such conditions occur for example while ascending a grade at a speed which does not require peak supercharged conditions but does require the operation of the supercharger. If the throttle is not fully open, the throttle plate represents a pressure restriction downstream of the supercharger creating a back pressure on the supercharger leading to increased horsepower consumption to drive the air pump and the resulting inefficient and unnecessary supercharging operation. The high pressure applied to the carburetor openings upstream of the throttle plate can also cause flooding and wastage of fuel.

In U.S. Pat. No. 2,486,047 to Marinelli, there is disclosed an arrangement for controlling the power applied to the blower in accordance with the differential pressure across the engine throttle plate in order to vary the supercharging activity to maintain a constant pressure differential across the throttle plate. While potentially offering a way to alleviate the aforementioned difficulties, this arrangement involves the use of a variable speed drive which greatly increases the expense of the unit and renders it more or less impractical for such high volume automotive applications. Furthermore, this particular arrangement employs a nonpositive displacement blower which has a tendency to produce inadequate boost pressure and torque at relatively low engine speeds, as with turbochargers.

One type of positive displacement air pump which has been employed in the past in these applications is a vane pump of the general type including a plurality of radially extending vanes which are carried by a cylindrical rotor, which rotor is rotated within a housing chamber about an axis eccentric to that of the housing chamber and to a fixed offset axis shaft upon which are journalled the vane hubs.

As noted, the vanes disposed within a housing having a cylindrical section configuration, the center of which is also offset from the rotor axis, are such that rotation of the rotor within the housing produces increasing and decreasing volume working chambers intermediate the radial vanes. By providing suitably located inlet and exhaust ports in the housing chamber wall, a simple positive displacement air pump has been heretofore provided. The arrangement of a fixed offset axis shaft upon which the vane hubs are rotatably mounted has in the past generally been cantilevered, requiring a relatively large diameter shaft being employed together with relatively expensive combined radial and thrust bearing arrangements for each vane. Since such air pump is the major element in the expense of such unit, it of course would be advantageous if the cost of such unit could be reduced over such heretofore known designs for such high volume designs suited to the application described above.

A further difficulty is in the design of the unit and the air pump itself in that the design of the positive displacement generally requires very effective sealing of the moving elements as opposed to the nonexistent sealing of turbine blades with such sealing means also being required to be relatively durable for automotive applications.

Accordingly, it is an object of the present invention to provide a supercharging system for internal combustion engines which can provide high volume boost flow and pressure at relatively low engine speeds and which is operational only under high torque demand engine operating conditions so as to enable economy operation of the engine under low torque demand conditions, while providing improved performance characteristics during conditions of relatively high torque demand.

It is a further object of the present invention to provide such supercharging system in which the activation of the supercharger system does not result in a sudden increase in torque output of the engine due to the rapid increase in air pressure to the carburetor.

It is yet another object of the present invention to provide such supercharger system which does not involve the use of variable speed drives in order to control the output of the supercharger air pump.

It is still another object of the present invention to provide such supercharger system employing a relatively high volume positive displacement air pump in which the output flow is varied without significant throttling of the air flow into the engine in order to enable relatively high efficiency driving of the supercharger air pump.

It is another object of the present invention to provide an air pump for such supercharger system which provides relatively high pressure supercharging at low engine speeds in order to enable adequate engine torque increases at such low engine speeds.

It is still another object of the present invention to provide an improved version of a vane type air pump suitable for this application of the type including a plurality of radially extending vanes disposed within a cylindrical chamber formed in a housing, which vanes are rotated by an eccentrically journalled cylindrical rotor, carrying seals through which the vanes pass. The vanes are rotatably mounted on a fixed shaft offset from the rotor axis but on the chamber axis, in which simplified bearing arrangements are provided.

It is still another object of the present invention to provide such vane type air pump in which the vanes are supported by the offset axis fixed shaft securely such as to enable the close vane-to-housing clearance to yield a high efficiency pumping action.

SUMMARY OF THE INVENTION

These and other objects of the present invention, which will become apparent upon a reading of the following specification and claims, are achieved by a supercharger system consisting of a positive displacement relatively high volume output air pump mechanically driven by the engine, which drive is controlled by a clutch actuated under predetermined torque demand levels required during a range of engine operating conditions. Such torque demand may be sensed in several ways. One approach is to detect the decline of the differential pressure across the throttle plate to a predetermined level. This is advantageously accomplished by associating a switching arrangement with a modulator valve described below utilized to vary the boost flow. By a vacuum switch sensing of the predetermined vacuum level within the intake manifold of the engine or finally by a switch associated with the throttle valve. The clutch is activated by the particular switch arrangement to establish drive to the air pump and initiate supercharging air flow to the engine intake manifold.

The system further including an arrangement for modulating the flow from the supercharger to the engine in accordance with the sensed differential pressure existing across the engine throttle plate in order to provide a smooth transition of the boost pressure and supercharging flow without requiring a variable speed drive to the air pump.

Such modulation is achieved by a fluid pressure actuator controlling the position of the modulating valve mentioned above which modulates the flow from the supercharger air pump into the engine intake manifold.

Such modulation may be provided in several ways but preferably is by throttling the inlet flow to the air pump by means of a valve interposed in the inlet passage to the supply or inlet side of the air pump.

Alternatively, the supercharger flow may be modulated by providing a bypass arrangement routing the air pump output flow through a bypass passage to return to the inlet side of the supercharger thus reducing the airflow from the air pump into the intake manifold of the engine.

The position of the valve is controlled as a function of the sensed differential pressure by means of a diaphragm partitioning the actuator fluid pressure chamber to be subjected to the differential pressure, and acting against an operating spring tending to maintain a relatively constant pressure differential across the throttle plate. This results in a reduced boost flow to the engine under transition conditions upon initial activation of the drive clutch in order to smooth out the increase in torque output of the engine upon initial activation of the supercharger system.

In addition, under steady state operation at partial boost conditions, the supercharger output flow is reduced in order to enable relatively high efficiency driving of the air pump without developing high back pressures due to operation with the main throttle partially closed. This allows the activation and operation of the supercharger at partial boost as in ascending a grade at constant road speed.

This enables supercharging under steady state conditions at a given speed, with only a partial addition of boost pressure such as to enable the torque output of the engine operating under less than full boost conditions to be controlled.

In order to provide a changeover from naturally aspirated to supercharged operating conditions, a bypass passage air duct is provided directly from the engine air cleaner to the carburetor intake. The bypass duct is provided with a check valve which opens during normal or naturally aspirated engine operating conditions, but upon a development of sufficient supercharger flow to equal the volume requirements of the engine, the check valve is closed by the higher pressure existing at the carburetor intake due to the supercharger air pump operation.

The air pump design itself is a specially configured pump in which a dynamic biasing of the vanes is established to allow a simplification of the bearing arrangement supporting the vanes and to enable the relatively tight vane clearances with the housing to be held.

The vane pump is of the type including a series of radial vanes rotatably supported on an offset axis shaft and which vanes pass through slotted openings in a rotor supported for rotation about an axis eccentric to the offset axis shaft, which rotor is driven by the output from an electromagnetic clutch, which in turn is driven by a belt drive from the engine.

The rotation of the rotor produces corresponding rotation of the vanes within a pump housing chamber such as to pump air from an inlet port to an exhaust port by the vane motion, pressurizing the air in working chambers intermediate the vanes, the rotor and the housing chamber outer walls.

The vane pump configuration includes the vane supporting offset axis fixed shaft, which is secured at one end adjacent the end of the rotor opposite from which the rotor is driven. The shaft is hung on a shaft hanger rotatably supported on a stub shaft located on the axis of the rotor. The resultant circumferential motion allowed by the shaft hanger produces a slight deflection of the offset axis shaft which in turn produces a dynamic biasing of the vanes journalled on a main portion on the shaft toward the shaft hanger when the vanes are being driven.

Accordingly, the vanes, each of which are formed with pairs of axially spaced ring portions supported on needle bearing assemblies, are located against thrust loadings by simple thrust bearings interposed on the ring portions adjacent the shaft hanger side. The dynamic biasing insures that the vanes will be urged in that direction and also enables the relatively tight clearance to be established at this side of the vanes and the endwall of the rotor and chamber with a relatively large clearance at the other side to accommodate thermal growth of the vanes. The large clearance may be sealed with a spray-on carbon-graphite coating since such endwall does not normally experience axial loadings by the vanes due to the opposite dynamic biasing of the vanes. Simple radial load needle bearings thus may be employed to rotatably support vanes on the offset axis fixed shaft.

DESCRIPTION OF THE DRAWINGS

FIGS. 5 and 6 are diagrammatic representations of an alternate form of the supercharger system of FIGS. 3 and 4 shown just after initiation of supercharging.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
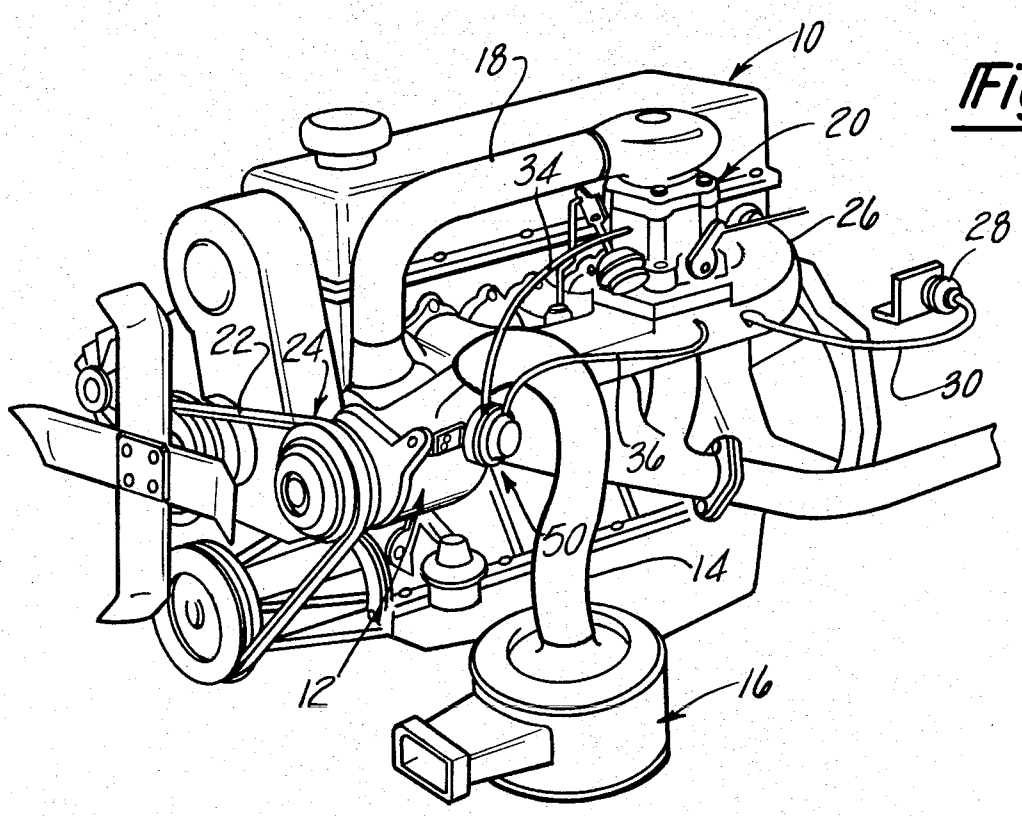
FIG. 1 is a partial view of an internal combustion engine equipped with a supercharger system according to the present invention.

Referring to FIG. 1, the supercharger system according to the present invention is shown installed in a carbureted spark ignition engine 10, but it should be understood that the control system could be applied to fuel-injected engines in which fuel flow is related to air flow.

The system includes a relatively large volume output positive displacement air pump 12 which is adequate to produce a boost pressure to the engine throughout the range which the air pump is activated, i.e., to increase the air pressure at the carburetor intake to six psig for a typical application.

The inlet to the air pump 12 is connected to ducting 14 associated with the engine air cleaner 16 so as to receive air from the air cleaner 16, pressurizing the air and pumping it via an outlet duct 18 to the intake of the engine carburetor 20.

The air pump 12 is driven mechanically by the engine at or close to engine speed via a belt drive 22 driven by the engine crank shaft and driving the pulley associated with the input of an electromagnetic clutch 24. The electromagnetic clutch 24 is activated or deactivated according to engine operating conditions dictating either the establishment of boost pressure to the engine for high torque demand, or normal aspiration for economy operation.

While control over the electromagnetic clutch 24 activation may be achieved by sensing any of several parameters, the illustrated method is that of detecting the vacuum level in the intake manifold 26. Thus, activation of the electromagnetic clutch 24 is controlled by a vacuum switch indicated at 28 which senses the manifold pressure and which controls circuitry (not shown) such as to cause the electromagnetic clutch 24 to be activated and driven to the air pump 12.

As noted above, the air flow from the supercharger air pump 12 is modulated so as to produce less than maximum boost pressure and flow during predetermined operating conditions of the engine. This is achieved according to the embodiment depicted in FIG. 3 by a modulating actuator 50 which positions a pivotable valve plate 46 interposed in the inlet of the air pump 12 so as to modulate the flow through the air pump 12. The positioning of the valve plate 46 is in accordance with a sensed differential pressure. For this purpose, hoses 34 and 36 are received on pressure taps, one located just upstream of the throttle plate in the engine carburetor 20 and the other downstream in the intake manifold 26. The positioning of the throttle plate is such as to tend to maintain the pressure differential thereacross during the period in which the air pump 12 is supplying boost pressure to the intake of the engine carburetor 20.

Figure 2:
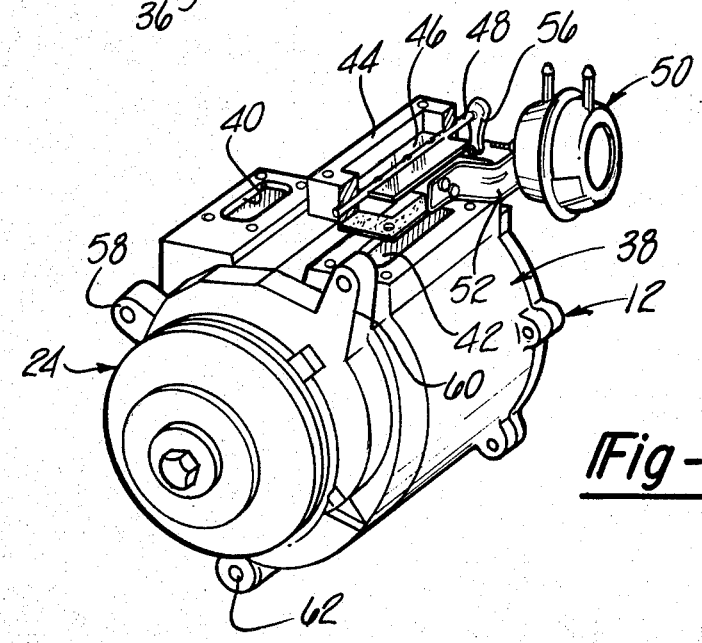
FIG. 2 is an enlarged perspective view of the air pump, clutch and portions of the manifolding associated therewith.

As seen in FIG. 2, the air pump 12 includes a housing 38 which is formed with an outlet port 40 and inlet port 42 which is connected to the respective inlet and outlet ducts 14 and 18 by means of fittings as shown in FIG. 1.

There is also provided a valve block assembly 44 including the pivotable valve plate 46 supported on cross shaft 48. The angular position of the valve plate 46 is controlled by the modulating actuator 50 mounted to the side of the valve block assembly 44 by a bracket 52. An operating lever 54 is movable to control the position of the valve plate 46.

The air pump housing is mounted to the engine by means of mounting eyes 58 and 60 which may be mounted to a simple bracket with pivoting movement about bushing 62 enabling adjustment of belt tension in known fashion.

Figure 3:
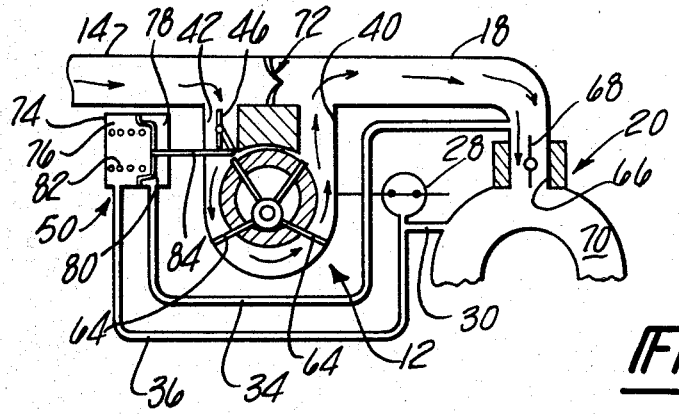
FIG. 3 is a diagrammatic representation of the supercharger system according to the present invention with the supercharger boost pressure being applied to the engine.
Figure 4:
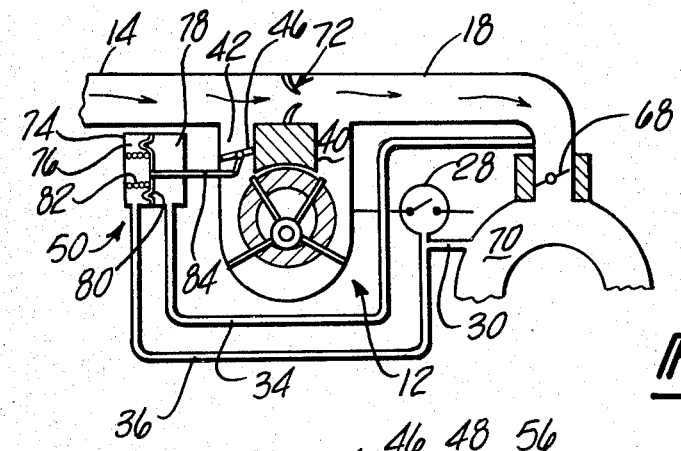
FIG. 4 is a diagrammatic representation of the system shown in FIG. 3 under natural aspiration conditions of the engine.

By reference to FIGS. 3 and 4, the functioning of the system can best be understood. During the supercharging mode, air passes into the inlet port 42 of the air pump 12 and is compressed by rotation of the air pump rotor 64 as will be described hereinafter with reference to a detailed description of the air pump 12.

The air passing out through outlet port 40 is pressurized, i.e., at a typical six psig and passes into the outlet duct 18, into the intake passage 66 of the carburetor 20 and into the intake manifold indicated at 70.

During the natural aspiration mode, air drawn into the engine passes into inlet duct 14 and through a check valve 72 interposed between the inlet duct 14 and outlet duct 18 which constitutes a bypass passage with respect to the air pump 12. The inducted air flow passes through the check valve 72 until such time as the volume of air flow induced into the engine cylinders is exceeded by the supercharging air flow. That is, until the air pump 12 has reached a volume of flow enabling pressurization of the outlet duct 18 above atmospheric pressure.

Activation of the electromagnetic clutch 24, as indicated, is by means of a vacuum switch 28 sensing the achievement of a predetermined vacuum level in the intake manifold 26.

The particular pressure chosen to produce clutch activation is preferably just below that developed by natural aspiration air flow into the engine (at peak air flow) with the resultant vacuum developed in the intake manifold as a result of flow restrictions of the air intake and carburetor.

Thus, as soon as the engine "needs" more air, the clutch 24 is actuated to initiate supercharging.

Typically, this vacuum is set at 2 to 3 inches of mercury as described above.

The modulation of air flow through the supercharger is achieved by the modulating actuator 50 which includes an outer housing 74 divided into respective pressure chambers 76 and 78 by a flexible diaphragm 80. The flexible diaphragm 80 is acted on so as to be urged to the right as viewed in FIG. 3 by an actuating spring 82. Each of the pressure taps are at downstream and upstream locations with respect to the throttle plate 68 and are connected via hoses 34 and 36 to pressure chambers 76 and 78, respectively, causing the pressure differential therebetween to act on the flexible diaphragm 80, counteracting the force of the actuating spring 82.

The flexible diaphragm 80 is connected to an operating rod 84 so as to move together therewith, which operating rod 84 in turn controls the angular position of the valve plate 46.

The actuating spring 82 urges the operating rod 84 to the right and tends to move the valve plate 46 to the fully open position as shown in FIG. 3.

The activation of the air pump 12 as noted is by means of the vacuum switch 28 which, according to the embodiment described, senses the achievement of a predetermined particular vacuum level of intake manifold 70.

The central concept of the supercharging system according to the present invention is to cause the engine to be operated without supercharging during normal torque demand conditions of the engine, but with supercharging initiated upon development of a torque demand condition at a predetermined level. Such torque demand condition can be determined in several different ways, including the aforementioned detection of a predetermined vacuum condition in the intake manifold corresponding to a torque demand level.

This detection of a vacuum condition is the detection of the vacuum in the intake manifold, which is just greater than a vacuum corresponding to that developed by the peak air flow through the intake manifold.

Another approach is the provision of a throttle linkage activated switch **28*a* (FIG. 5**) which activates the electromagnetic clutch upon the depression of the throttle pedal to a predetermined level indicating a high torque demand by the vehicle operator.

However, there are some engine conditions when the throttle switch arrangement may not trigger properly inasmuch as the throttle switch would have to be tripped at a close to wide open throttle position, whereas the demand for supercharging may be indicated at a throttle angle substantially less than wide open throttle.

Another approach which is preferred is to associate a switch **28*b* (FIG. 6) directly with the modulator actuator itself such as to cause activation of the clutch whenever the modulating actuator 50** begins to open. This arrangement constitutes means for detecting the decline of the differential pressure level just below a predetermined level.

It can be appreciated that by incorporation of a modulating control means associated with the supercharger inlet that the aforementioned difficulties created by the rapid increase in engine torque output upon activation of the supercharger are obviated. This also enables partial boost supercharging without creating a back pressure acting on the positive displacement air pump, which would entail a torque penalty with the increased resistance to driving of the air pump 12.

This also eliminates the imposition of high pressures under these conditions upstream of the throttle plate in the various carburetor flow passages. This result is achieved since upon initial activation of the supercharger, the valve plate 46 is substantially closed, and moves to the fully opened position only as the pressure in the intake manifold 70 increases due to the boost flow into the intake manifold thus smoothing the transition to the higher torque output of the engine by providing a gradual increase in boost flow in the instance of a wide open initial throttle valve movement.

Similarly, if the throttle plate 68 is partially closed, the resultant pressure differential would control modulation by the positioning of the valve plate 46 to produce a reduced supercharger flow by maintaining a substantially constant pressure differential across the throttle plate 68.

The reduced supercharger flow does not result in greater horsepower loss to drive the air pump 12, since the inlet is modulated, reducing the drive horsepower necessary. This thus produces a highly efficient supercharging action under partial boost operation, as may occur in ascending a grade near wide open throttle position, which grade requires the boost in engine output of the supercharger system.

While the supercharger flow modulation by means of an inlet valve is the preferred embodiment, it is also possible to achieve modulation of the supercharger flow via wastegating of the supercharging outflow rather than throttling. Outlet throttling, as noted, is disadvantageous due to the development of back pressure conditions which entail increased resistance horsepower requirements for a given flow over the inlet valving arrangement.

Figure 7:
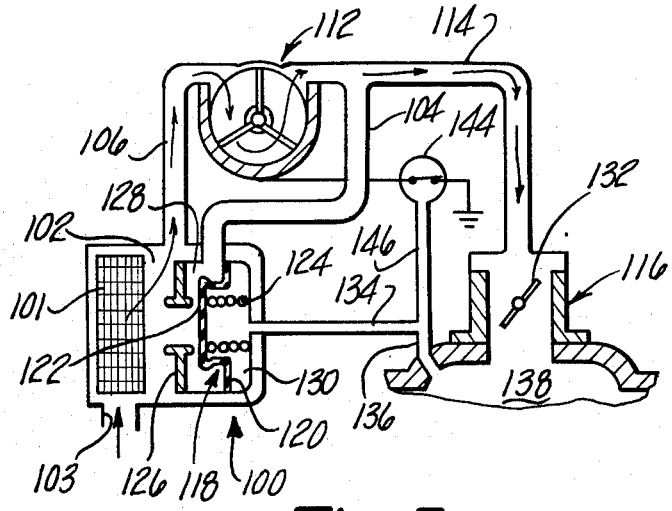
FIG. 7 is a diagrammatic representation of an alternate form of the supercharger system according to the present invention depicted in the supercharging mode.
Figure 8:
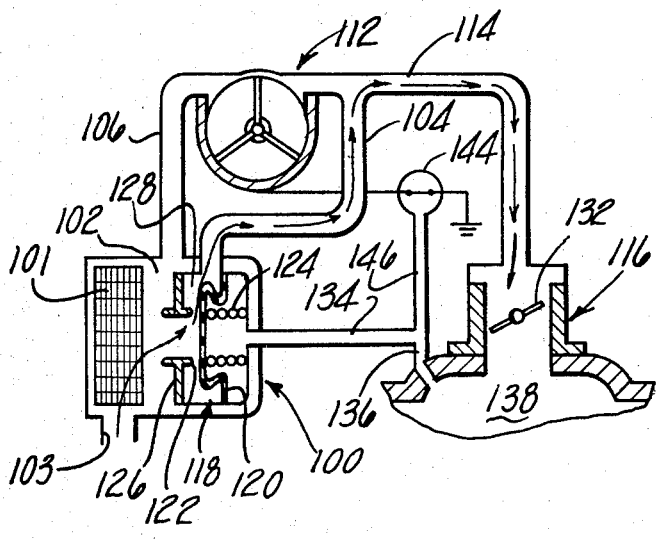
FIG. 8 is a diagrammatic representation of an alternate supercharger system according to the present invention depicted in the supercharging mode.

Such a wastegating arrangement is depicted diagrammatically in FIGS. 7 and 8.

In this arrangement, a supercharger modulator valve 100 includes an intake chamber 102 provided with air intake through a snorkel passage 103 passing through a filter element 101. Intake air passes from the chamber 102 into an inlet passage 106 associated with the air pump 112.

The outlet passage 114 is connected to the carburetor intake 116 as in the above-described embodiment.

The modulator valve 100 includes a diaphragm 118 including a diaphragm end plate 120 movable against a valve seat indicated at 122 establishing communication from the intake chamber 102 to a bypass duct 104. A spring 124 acts on the diaphragm end plate 120 to urge it into engagement with the valve seat 122 to disestablish communication of the intake chamber 102 and the bypass duct 104.

The diaphragm 118 subdivides the region on the other side of the valve seat 122 defined by partition 126 into two different regions, in one region 128 which is at supercharger output pressure while the other region 130 is at the pressure existing downstream of the throttle plate 132 by means of a pressure tap 134 and branch passage 136 extending into the intake manifold 138.

Thus, the diaphragm 118 is subjected to the differential pressure or pressure drop experienced across the throttle plate 132.

Under conditions of normal aspiration during which the supercharger is not operating, the pressure differential across diaphragm 118 causes the diaphragm 118 to be withdrawn from the valve seat 122. Air can then flow from intake chamber 102 to region 128 and through bypass duct 104 to the engine.

Drive to the air pump 112 is activated by a vacuum switch 144 controlling a clutch (not shown) in similar fashion to the above-described embodiment. A branch passage 146 causes tripping of the pressure switch whenever the intake manifold vacuum drops below the vacuum produced by peak naturally aspirated air flow by the intake restrictions, i.e., at 2 to 3 inches of vacuum in intake manifold 138.

Under supercharging conditions, the modulator valve 100 operates to modulate the outlet flow into the engine by wastegating a portion of the air flow through bypass duct 104 and out through the valve seat 122, under conditions of a pressure differential across the throttle plate 132 exceeding a predetermined level, as indicated in FIG. 7.

This approach also reduces the load on the supercharger air pump 112 while being effective to achieve the desired smooth transition upon activation of the supercharger air pump 112. However, wastegating back through the air intake chamber 102 may increase the noise level during air pump operation and accordingly the first-described embodiment is preferred.

Figure 9:
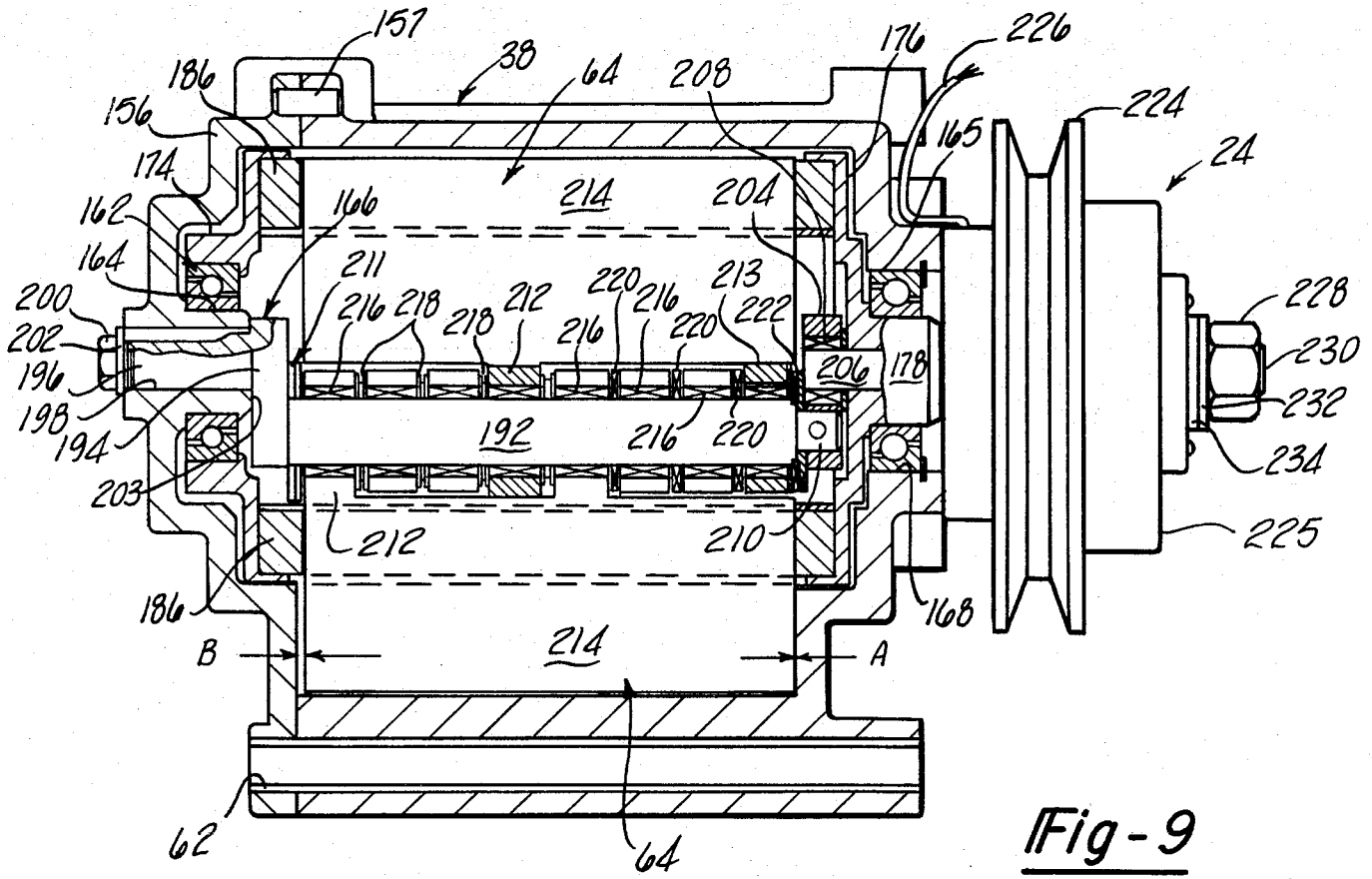
FIG. 9 is a partially sectional view of the air pump employed in the system according to the present invention, as well as the magnetic clutch associated therewith.
Figure 10:
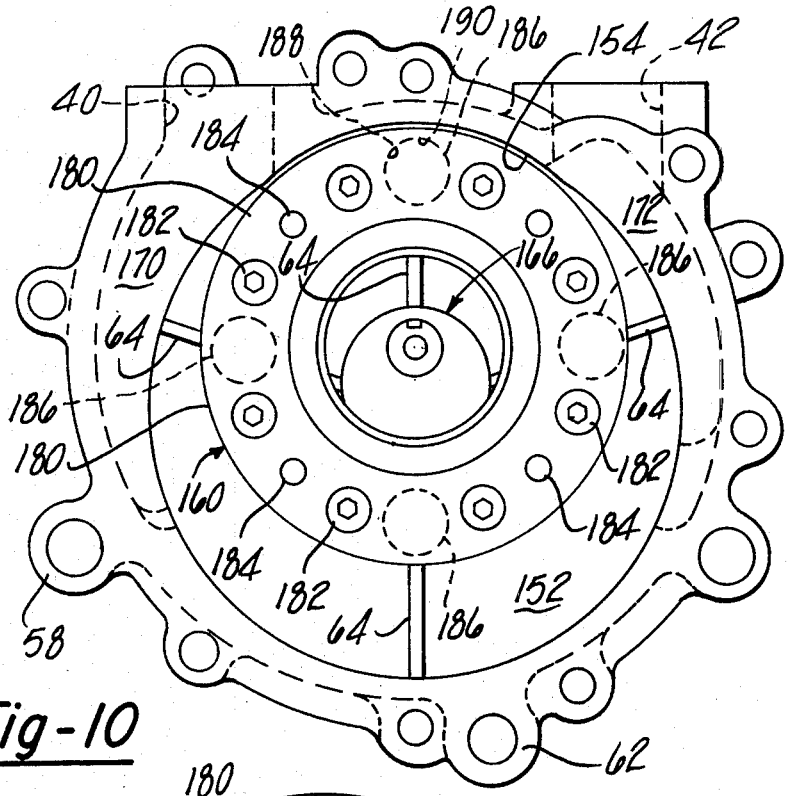
FIG. 10 is an endwise view of the assembly shown in FIG. 7, rotated 90°.
Figure 11:
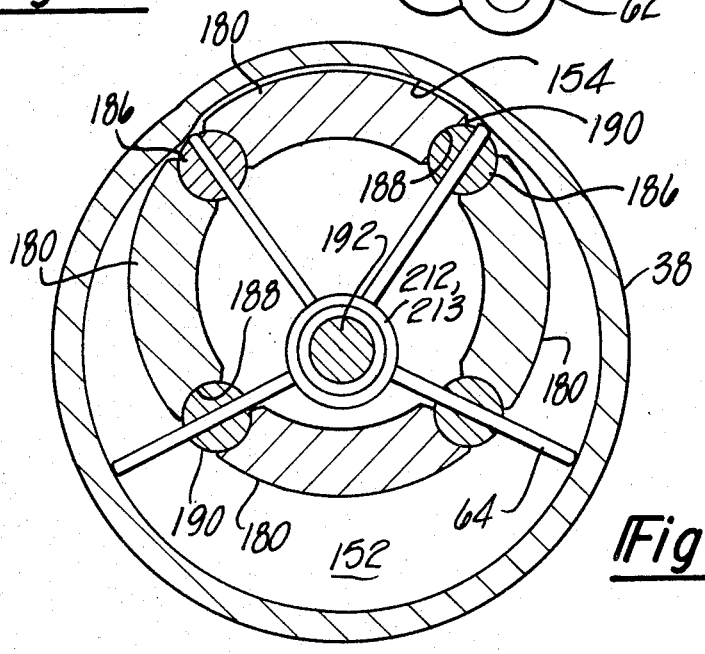
FIG. 11 is a sectional view through the air pump working chamber shown in FIG. 8.

The specifics of construction of the air pump utilized in the supercharger system according to the present invention can be seen in FIGS. 9 through 11. This type of air pump is generally known, but as hereinafter described, certain specifics of the construction details are such as to establish an endwise dynamic biasing of the vanes which enables certain improvements to be made to the vane support and mounting within the pump. The general type of air pump comprises the previously mentioned housing 38 having a substantially circular in configuration chamber 152, with a slightly offset arcuate recess 154 for purposes to be hereinafter described.

The housing 38 is provided with a cover plate 156 at one end secured thereto by means of cap screws 157. Rotatably supported in the generally cylindrical housing chamber 152 is a rotor assembly 160 supported by means of radial bearing 162 supported on a pilot section 164 of the cover plate 156 and also by a combined radial-thrust bearing 165 disposed within a bore 168 formed in an end wall of the housing 38 opposite the cover plate 156.

The rotor assembly 160 is supported for rotation about an axis offset from the centerline of the housing chamber 152, and aligned with the centerline of the arcuate recess 154 so that its periphery is rotated adjacent the arcuate recess 154. This is for the purpose of providing a superior sealing action between the high pressure and lower pressure regions of the interior of the housing, since opposite sides of the adjacent areas define high and low pressure regions, and the long leak path aiding in sealing.

The vanes 64 in turn are rotatably supported on an offset fixed shaft 166 which extends along an axis eccentric to the axis of rotation of the rotor assembly 160, but aligned with the centerline of the housing chamber 152. On either side of the arcuate recess 154 is provided inlet port 170 and outlet port 172 entering into communication with the housing chamber 152.

The relationship of the respective ports is such that as the rotor assembly 160 rotates in a counterclockwise direction as viewed in FIG. 10, air is drawn in through the inlet port 170, compressed and passed out through the outlet port 172.

The vanes are rotated together with the rotor assembly 160 about an axis aligned with the chamber 152, thus enabling the outer tips to be closely adjacent to compress the interior surface of housing chamber 152.

The spaces between the vanes 64 define a series of pumping chambers which increase in size to the 180° position from top dead center (as viewed in FIG. 8) and thence decrease in volume.

Thus, as noted, air is drawn in through the inlet port 170, and compressed in the chamber defined by the intermediate spaces between the successive vanes 64 and the space within the chamber 152 intermediate the rotor assembly 160 and the chamber outer wall. The air so compressed is passed out through an outlet port 172.

This general type of vane pump offers the advantage of a positive displacement of air due to the minimal clearance between the vane tips and chamber 152 wall.

The rotor assembly 160 includes a rotor end cap 174 supported on the radial bearing 162 and a flanged rotor shaft member 176 which is formed integrally with an input shaft section 178 rotatably supported on the radial thrust bearing 165. A series of rotor segments 180 are secured to the rotor end cap 174 and flanged rotor shaft member 176, respectively, by a series of cap screws 182 with doweling 184 provided for accurate alignment of parts.

Each of the rotor segments 180 is circumferentially spaced apart with the intermediate spaces each receiving a slotted sealing cylinder 186 which is rotatably movable within the partially cylindrical openings 188 defined thereby. Each of the vanes 64 pass from the interior of the rotor assembly 160 into the chamber 152.

As noted, each of the slotted sealing cylinders 186 is rotatably mounted within the recess partially cylindrical opening 188 and thus accommodates the relative angular change in position of the vanes 64 with respect to the rotor assembly 160, as the rotor assembly 160 rotates.

The slotted sealing cylinders 186 may be of a suitable lightweight wear resistant material such as a hard plastic. The vanes 64 are preferably of a lightweight aluminum alloy and may be anodized for improved sealing and wearing characteristics with respect to the slotted sealing cylinders 186.

Other vane sealing arrangements are provided in order to improve the sealing characteristics between the vane 64 as it slides in and out of the sealing slot insuring that the pressurized air is not lost within the interior of the rotor such as the provision of camming rollers intermediate the vane sides and the sealing cylinder slots, as well as spring loaded seal wipers.

Accordingly, the vanes 64 slide in and out the slotted sealing cylinders 186, and relative rotation of the cylinder 186 accommodates the relative angular movement between the rotor assembly 160 and each of the vanes 64.

The vanes are rotatably supported on the offset fixed shaft 166 as previously indicated. Offset fixed shaft 166 includes a main shaft portion 192 with its axis aligned with the centerline of the chamber 152 supported in the offset position of the offset arm 194 integral with an end portion 196 at one end of the main shaft portion. The end portion 196 in turn is received within a bore 198 formed in the cover plate 156 and keyed thereto and retained by a bolt 200 and washer 202. Bolt 200 is received within a threaded bore in the end portion 196 drawing the shaft into abutment against the end face 203 of the pilot portion 164 of the cover plate 156.

Thus, the offset fixed shaft 166 is both rotatably and angularly fixed with respect to the housing 38 to align the axis in the proper relationship with respect to the chamber 152 and to preclude rotation thereof as the rotor assembly 160 rotates.

The opposite end of the offset fixed shaft 166 is supported by a shaft hanger 204. Shaft hanger 204 is rotatably supported on a stub shaft extension 206 press fit within the interior of the flanged rotor shaft member 176 on the housing axis. A needle bearing 208 supports the shaft hanger 204 and accommodates the rotation of the rotor assembly 160. The main shaft section 192 provides a stub end section 210 which is received within a corresponding bore and lower portion of shaft hanger 204.

Thus, the main shaft portion 192 is securely supported against radial loads to securely support the vanes 64, which minimizes the tendency for deflections resulting in radially outward movement of the vanes 64 and either increased wear of the vane tips or the need for a larger radial clearance between the chamber outer wall and the vane outer tips.

At the same time, the shaft hanger 204 enables a limited degree of circumferential movement and corresponding deflection of the main shaft portion 192, although to a relatively slight degree. It has been discovered by the present inventors that this results in the "dynamic biasing" of the vanes 64 since the forces exerted on the main shaft portion 192 are such as to result in a slight circumferential deflection of the main shaft portion 192 which in turn generates axial forces acting on the vanes 64 tending to urge them toward the shaft hanger 204 or to the right as viewed in FIG. 7.

Thus, during rotation of the rotor assembly 160, the vanes 64 may be presumed to be in the rightmost position as viewed in FIG. 9. This result requires the support for the thrusting loads in this direction.

This also enables such thrusting loads to be taken by a limited number of thrust bearings and also insures that the endwise loads exerted by the loads be only on the rightmost side.

Furthermore, this situation allows the endwise clearance required to accommodate the axial thermal growth of the vanes 64 relative to the rotor and housing to be measured from the rightmost position.

Accordingly, the clearance space A may be defined as minimum running clearance, while the clearance space B may be set for the running clearance plus thermal growth. This results in relatively large clearance but this clearance space may be filled with a spray deposited commercially available carbon-graphite compound which have been commonly utilized in such applications with a hard stop constituted by washer 211 provided for occasional movement of the vanes 64 to the left position.

The wear of the carbon-graphite provides a relatively tight clearance since the vanes do not normally run with a leftward thrusting force exerted.

The vanes 64 are each supported by axially spaced left and right ring portions 212 and 213 integral with the flat blade portion 214, which ring portions 212 and 213 are provided with radial support by means of needle bearings 216 supported on the main shaft portion 192 with intermediate grease seals 218 provided in order to prevent the migration of grease into the chamber.

Since the vanes are dynamically biased to the right, only the right ring portions 213 need have thrusting support, inasmuch as only thrusting forces in the right direction need to be absorbed.

Accordingly, a plurality of thrust bearings 220 are provided intermediate each of the right ring portions 213. In addition, a main thrust bearing 222 is provided which absorbs the endwise thrust against the shaft hanger 204.

The relatively low cost needle bearings 216 allow axial movement with the limited number of thrust bearings 220 and 222 utilized in order to absorb the axial force.

The electromagnetic clutch 24 may be of conventional construction, with an input drive pulley 224 driven by the belt drive 22, which with the clutch energized drives an outer hub 225. The outer hub 225 in turn is drivingly connected to the input shaft section 178 with the assembly secured by a nut 228 and threaded end section 230 of the input shaft 178 with a lock washer 240 and flat washer 242.

Electrical leads 226 to the clutch 12 allow energization via the switch 28 described above.

Accordingly, it can be seen that the air pump design provides a high volume positive displacement design which is relatively light in weight and low in cost to manufacture to be suitable for large volume production as for passenger car applications.

The embodiments of the invention in which an exclusive property or privilege is claimed are defined as follows:

1. A supercharging system for an internal combustion engine having an air intake with an intake throttle valve disposed therein controlling the flow of air into said air intake, said system comprising:

air pump means for receiving air through an inlet and producing a flow of compressed air into said air intake;

means mechanically driving said air pump means by said internal combustion engine, said means including clutch means operable to selectively establish drive to said air pump means;

clutch control means including means causing said clutch means to be activated in a predetermined operating range of said internal combustion engine and causing said clutch means to be deactivated with said internal combustion engine operating outside of said predetermined range;

means establishing natural aspiration into said air intake whenever said compressed air flow from said air pump means into said air intake is below a predetermined level;

modulator means responsive to the pressure in the air intake on opposite sides of the intake throttle valve for varying the air flow from said air pump means to said air intake as a function of the pressure differential across said throttle valve, reducing said air flow whenever said pressure differential is above a predetermined maximum level;

whereby said supercharging air flow is modulated to provide a transition to maximum air flow upon activation of said clutch means, and to enable less than maximum air flow under part throttle conditions.

2. The supercharging system according to claim 1 wherein said modulator means includes inlet valving means varying the inlet air flow to said air pump means, whereby said supercharger flow is modulated.

3. The supercharging system according to claim 2 wherein said inlet valving means includes a valving member and also includes a valve actuator means variably positioning said valving member as a function of said pressure differential across said throttle valve.

4. The supercharging system according to claim 3 wherein said valve actuator means includes an actuator housing and diaphragm mounted in said housing establishing a pressure chamber on either side thereof and further including spring means in one of said pressure chambers biasing said diaphragm in a first direction tending to position said inlet valving means so as to increase air flow and wherein pressure tap means are provided causing pressure downstream of said throttle valve to be introduced into said chamber containing said spring member and wherein said pressure tap means is provided causing a pressure condition upstream of said throttle valve to be exerted in said other of said pressure chambers.

5. The supercharging system according to claim 4 wherein said inlet valving means comprises a valve plate pivotally supported in said inlet to said air pump means, wherein said valve actuator means further includes a valve actuating rod drivingly connected to said valve plate moved in accordance with said variable position of said diaphragm.

6. The supercharging system according to claim 3 wherein said valve actuator means includes means for maintaining a pressure differential across said throttle valve equal to two inches of mercury.

7. The supercharging system according to claim 1 wherein said clutch control means includes pressure sensor means sensing the pressure downstream of said throttle valve, said sensor means activating said clutch means whenever said pressure reaches a level above a predetermined pressure.

8. The supercharging system according to claim 7 wherein said pressure sensor means activates said clutch means whenever said pressure level downstream of said throttle valve is two to three inches of mercury.

9. The supercharging system according to claim 7 wherein said pressure sensor means activates said clutch means whenever said pressure level downstream of said throttle valve corresponds to the pressure in said air intake at maximum air flow to said engine passing through said air intake.

10. The supercharging system according to claim 3 wherein said inlet valve is positioned in a closed position whenever said pressure differential is above said predetermined maximum level and wherein said clutch control means is a switch means associated with said inlet valving means activating said clutch means upon initial opening of said inlet valving means.

11. The supercharging system according to claim 1 wherein said clutch control means is a switching means associated with said throttle valve for activating said clutch means upon movement of said throttle valve through a predetermined extent of travel.

12. The supercharging system according to claim 1 wherein said clutch means is an electromagnetic clutch means energized in said predetermined operating range of said engine for establishing drive to said air pump means from the engine.

13. The supercharging system according to claim 1 wherein said air pump means includes a positive displacement pump producing said compressed air flow.

14. The supercharging system according to claim 1 wherein said modulating means comprises outlet valving means varying said outflow of said air pump means in correspondence with said sensed pressure differential across said throttle valve.

15. The supercharging system according to claim 14 wherein said outlet valving means includes a bypass duct extending between said inlet to said air pump between said inlet of said air pump and said outlet of said air pump means, wherein said outlet valving means controls communication through said bypass duct means.

16. The supercharging system according to claim 14 wherein said outlet valving means includes a valve housing and further including a valving member disposed in said valve housing, said valve housing interposed in said bypass duct, means variably positioning said valving member in said valve housing in correspondence with said pressure differential across said throttle valve, whereby said flow through said bypass duct provides said outlet flow modulation of said air pump means air flow.

17. The supercharging system according to claim 1 wherein said means providing naturally aspirated air flow into said intake includes a bypass flow means and also includes a check valve disposed therein.

18. The supercharging system according to claim 1 wherein said engine is a spark ignition engine having a carburetor, and wherein said air pump means includes means directing said flow of compressed air into said carburetor.

* * * * *